US012514391B2

(12) United States Patent
Sieff

(10) Patent No.: US 12,514,391 B2
(45) Date of Patent: Jan. 6, 2026

(54) MAILBOX IMPACT RETURN SYSTEM

(71) Applicant: William Sieff, North Haven, CT (US)

(72) Inventor: William Sieff, North Haven, CT (US)

( * ) Notice: Subject to any disclaimer, the term of this patent is extended or adjusted under 35 U.S.C. 154(b) by 0 days.

(21) Appl. No.: 18/463,885

(22) Filed: Sep. 8, 2023

(65) Prior Publication Data

US 2024/0081571 A1 Mar. 14, 2024

Related U.S. Application Data

(60) Provisional application No. 63/404,661, filed on Sep. 8, 2022.

(51) Int. Cl.
*A47G 29/12* (2006.01)

(52) U.S. Cl.
CPC ..... *A47G 29/1216* (2013.01)

(58) Field of Classification Search
CPC ..... A47G 29/1216; E01F 9/627; E01F 9/629
See application file for complete search history.

(56) References Cited

U.S. PATENT DOCUMENTS 1,753,506 A * 4/1930 Florine ..... A47G 29/1216 119/786
2,103,410 A * 12/1937 Frei, Jr. ..... E01F 9/627 404/10
2,522,983 A * 9/1950 Bergstrom ..... A47G 29/1216 248/145
2,949,324 A * 8/1960 Birge ..... E01F 9/627 403/336
3,161,397 A * 12/1964 Nolander ..... A47G 29/1216 248/417
3,899,150 A * 8/1975 Racquet ..... E01F 9/629 403/111
4,106,879 A * 8/1978 Diedershagen ..... E01F 9/629 40/608
4,491,438 A * 1/1985 Berutti ..... A63C 19/062 40/608
4,792,088 A * 12/1988 Bonnell ..... A47G 29/1216 248/156
5,029,783 A * 7/1991 Alvarez ..... A47G 29/1216 40/608
5,207,377 A * 5/1993 Brecht ..... A47G 29/1216 248/548
5,215,283 A * 6/1993 Gould ..... A47G 29/1216 248/548
5,354,144 A * 10/1994 Lizakowski ..... E01F 9/629 404/10
5,400,959 A * 3/1995 Cone ..... A47G 29/1216 232/39
5,433,376 A * 7/1995 Kueshner ..... A47G 29/1216 232/39
5,624,210 A * 4/1997 Baldwin ..... E04H 12/2215 40/608
6,223,982 B1 * 5/2001 Dunn ..... A47G 29/1216 248/548

(Continued)

*Primary Examiner* — William L Miller
(74) *Attorney, Agent, or Firm* — Farber LLC

(57) ABSTRACT

A mailbox impact return system with a spring and controlled rate retraction/contraction device is provided that addresses problems associated with damage to mailboxes/mail-posts caused by the impact of snow. Additionally, the mailbox impact return system is provided that combines flexibility and a return action.

14 Claims, 5 Drawing Sheets

(56) References Cited

U.S. PATENT DOCUMENTS

| | | | | |
|---|---|---|---|---|
| 7,032,811 | B1 * | 4/2006 | Paulic | A47G 29/1216 248/156 |
| 8,613,412 | B1 * | 12/2013 | Donaldson | A45F 3/44 40/607.1 |
| 9,924,821 | B1 * | 3/2018 | Shamas | A47G 29/1216 |
| 11,028,544 | B2 * | 6/2021 | Steele | E01F 9/638 |
| 2004/0228677 | A1 * | 11/2004 | Henriques | A47G 29/1216 403/229 |
| 2009/0283659 | A1 * | 11/2009 | Newbill | G09F 7/18 248/624 |
| 2012/0001051 | A1 * | 1/2012 | Williams | A47G 29/1216 248/519 |
| 2013/0022396 | A1 * | 1/2013 | Hannah | E01F 9/629 404/10 |
| 2014/0021311 | A1 * | 1/2014 | Lenz, Jr. | A47G 29/1216 248/156 |
| 2015/0121733 | A1 * | 5/2015 | Oberkofler | E01F 9/629 40/607.06 |
| 2016/0123032 | A1 * | 5/2016 | Brodie | F16B 9/09 248/617 |
| 2018/0010308 | A1 * | 1/2018 | Mandal | E01F 9/631 |

* cited by examiner

130

MAILBOX IMPACT RETURN SYSTEM

FIELD OF THE INVENTION

The invention relates to a system for absorbing an impact on a mailbox. More particularly, the present invention relates to an impact assembly for a mailbox that combines flexibility and a return action.

BACKGROUND OF THE INVENTION

According to the US Postal Service, there are over 150 million residential mail delivery points in the United States. Many of these residential delivery points have mail-post/mailbox assemblies. Another large portion of these delivery points are located in areas with high levels of snow and snow removal.

SUMMARY OF THE INVENTION

Snow removal leads to the destruction of thousands of mailboxes each year. For those whose mailboxes or mail-posts have been destroyed, replacement costs can be more than $100. Furthermore, such replacements are not guaranteed to be protected from future snow impact damage.

Accordingly, it would be advantageous to provide a system that prevents and/or mitigates the damage caused to mailboxes and mail-posts.

What is desired is a system that allows a mailbox and/or mail-post to absorb a measure of impact from incoming snow. It is further desired that such a system allow for the automatic return of said mailbox/mail-post assembly to an upright position.

In one configuration, a system is provided comprising at least one first attachment point, a housing configured to be attached to a mailbox/mail-post, a post, a spring connected from a first point on the housing to a first point on the post, a controlled rate retraction device parallel to the spring connected from a second point on the housing to a second point on the post, and a hinge linking the housing with the post, wherein a separation between a first face of the housing and a face of the post is achieved in a predeterminable direction, and the separation having an angle range of at least 0 to 90 degrees. The controlled rate retraction device quickly extends to absorb the energy of an impact on the mailbox/mail-post from an impacting material such as snow, while the spring forces a retraction/contraction of a mailbox/mail-post to an upright position.

The controlled rate retraction device then retracts, providing a slow/controlled return of the mailbox/mail-post from a use position to a second position such as from a lateral position to an upright position. The first attachment point allows for the mating of the apparatus with a mailbox/mail-post. The post can be an assembly comprising a stake and the first face of the post. In one configuration, the spring has a spring constant value of at least 3 lbs./ft. to 50 lbs./ft, more preferably, 4-30 lbf/ft, even more particularly 5-20 lbf/ft. In certain preferred embodiments, the spring constant is 6-10 lbf/ft, or about 6.5-8 lbf/ft. The spring is preferably a compression spring, an extension spring, a torsion spring, a constant force spring, a Belleville spring, a drawbar spring, a volute spring, a garter spring, a flat spring, a gas spring, or an air spring. In one configuration, the controlled rate retraction device is a pneumatic cylinder. In one configuration, the housing attaches to the post with a hinge.

Other objects of the invention, its particular features, and advantages will become more apparent from consideration of the following drawings.

DETAILED DESCRIPTION OF THE INVENTION

Figure 1:
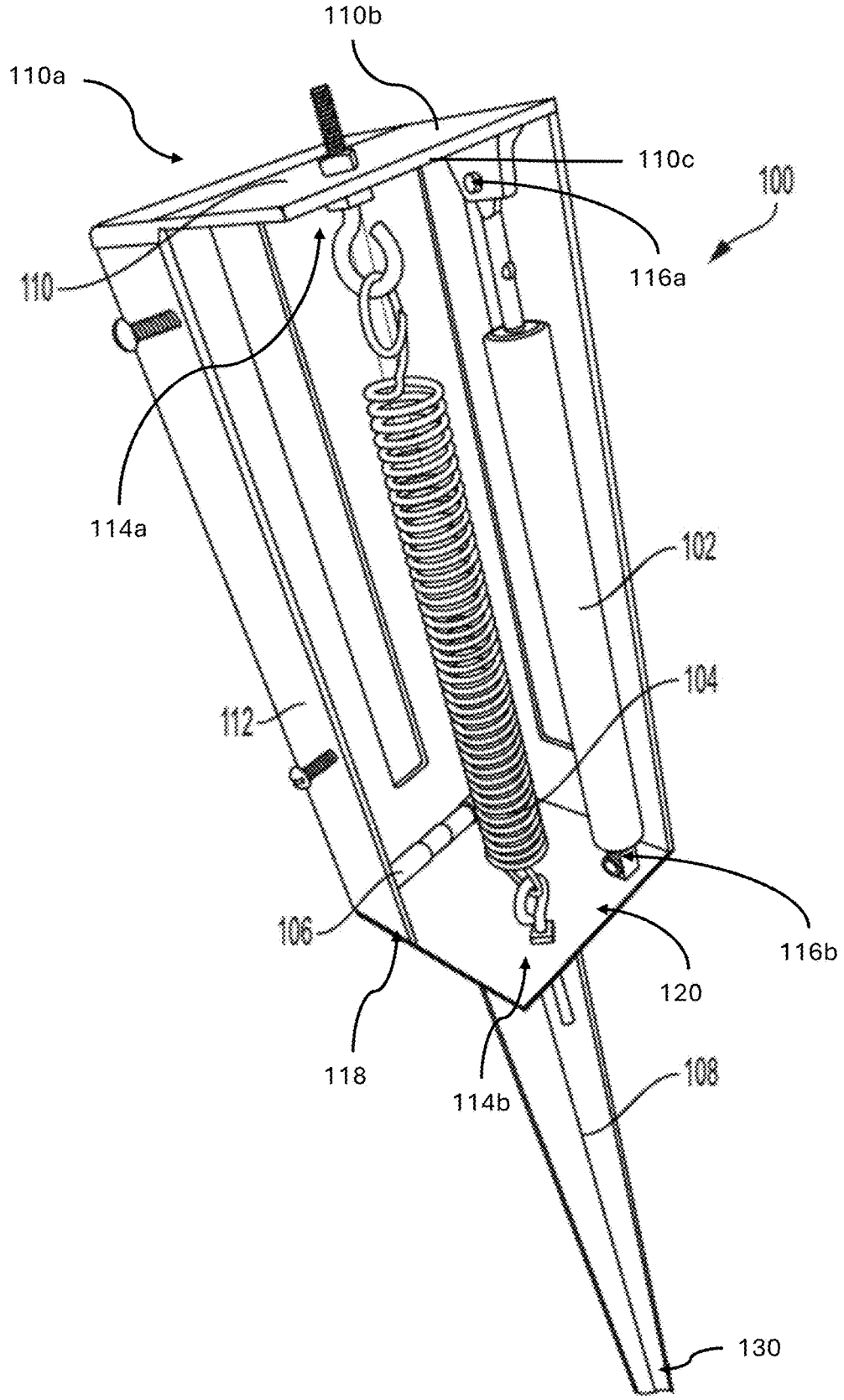
FIG. 1 is a perspective view of the mailbox impact return system according to a first configuration of the invention, in an upright position.

Referring now to the drawings, wherein like reference numbers designate corresponding structure throughout the views.

FIG. 1 shows a first embodiment of a mailbox impact return system 100. A first attachment point 110 can be located at a first end of the system 110*a*. The first attachment point 110 can also be a first attachment point located on an upper side of a housing 110*b* or a first attachment point located on a lower side of the housing 110*c*. A spring 104 and a controlled rate retraction device 102 can connect laterally across a housing configured to be attached to a mailbox/mail-post. A spring 104 can be connected from a first point on the housing 114*a* to a first point on a post 114*b*. A controlled rate retraction device 102 can be positioned parallel to the spring 104, and can be connected from a second point on the housing 116*a* to a second point on the post 116*b*. The housing 112 can have a first face 118. A post 108 can be formed from a stake 130 and a first face of the post 120. In one embodiment of the invention, the housing 112 and post 108 can be linked by a hinge 106. FIG. 1 shows a 0 degree separation between the first face of the housing 118 and a first face of the post 120. The hinge 106 can allow for movement of the housing 110 relative to the post 108 in a predeterminable direction. The stake 130 can allow the post 108 to keep and retain stability, and can be hammered slightly in the ground as seen in FIG. 1 or further into the ground in another embodiment of the invention, or inserted/embedded in a concrete anchor which extends below ground.

Figure 2:
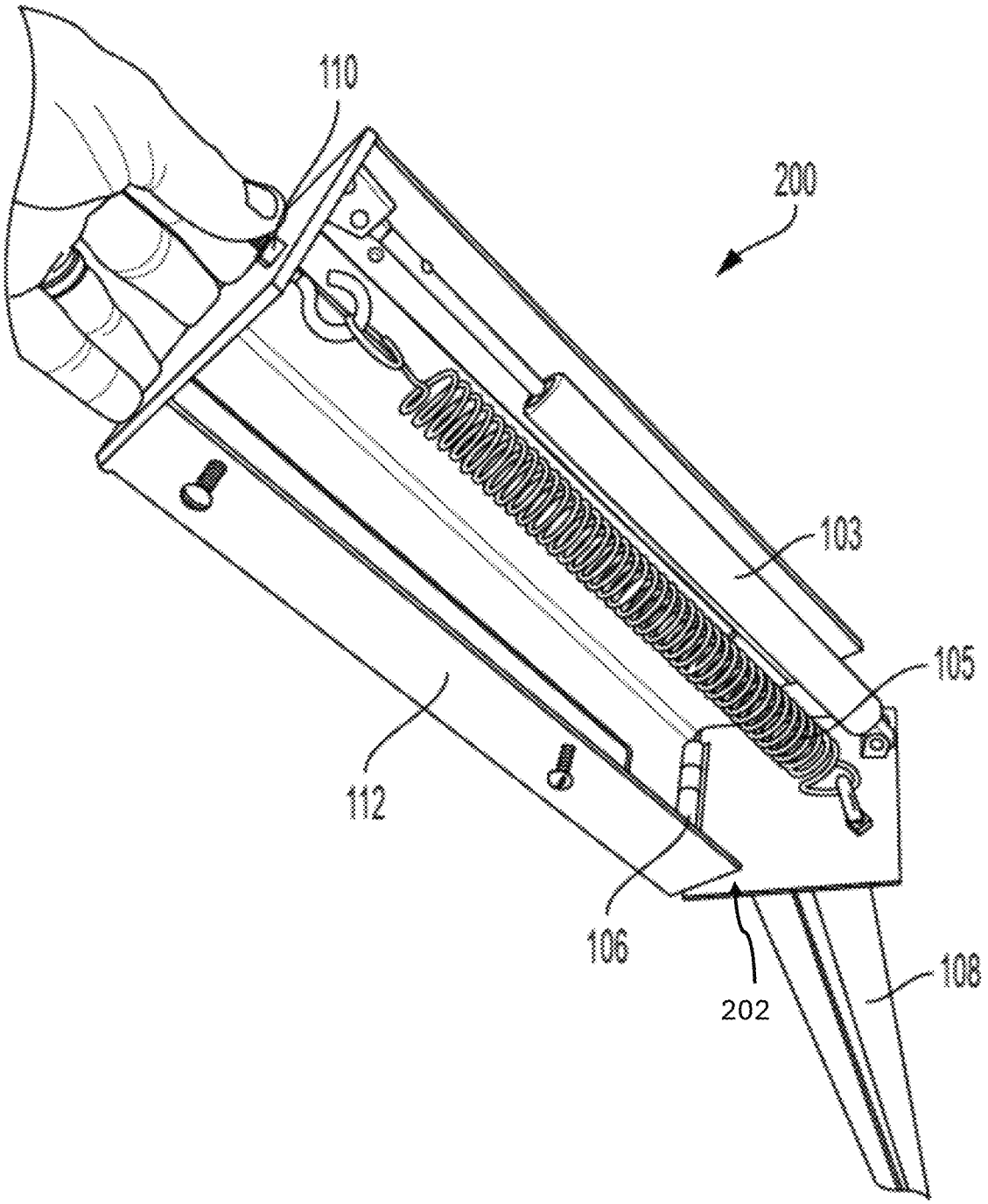
FIG. 2 is a perspective view of the mailbox impact return system according to the first configuration of the invention, in an extended position.

Now referring to FIG. 2, the mailbox impact return system is in an extended position 200. Connecting laterally across the housing 112 a spring in an extended position 105 and a controlled rate retraction device in an extended position 103 are present. The hinge 106 can allow the housing 112 to pivot at an angle relative to the post 108. In an extended position, a separation 202 can be seen to appear between the first face of the housing 118 and the first face of the post 120. The spring in an extended position 105 exhibits to a force causing the housing 112 towards a vertical position. The controlled rate retraction device in an extended position 103 does not exhibit a force but counteracts the exhibited force of the spring in an extended position 105 such that it causes the housing's return to the vertical position to be more consistent. The first face of the housing 118 can be a flat edge, which when it hits the first face of the post 120 can stop the retraction forces of the extended spring 105 and spring 104, and can hold the housing 112 in a vertical position. The first attachment point 110 is being held by a hand to indicate the mailbox impact return system in an extended position 200.

Figure 3:
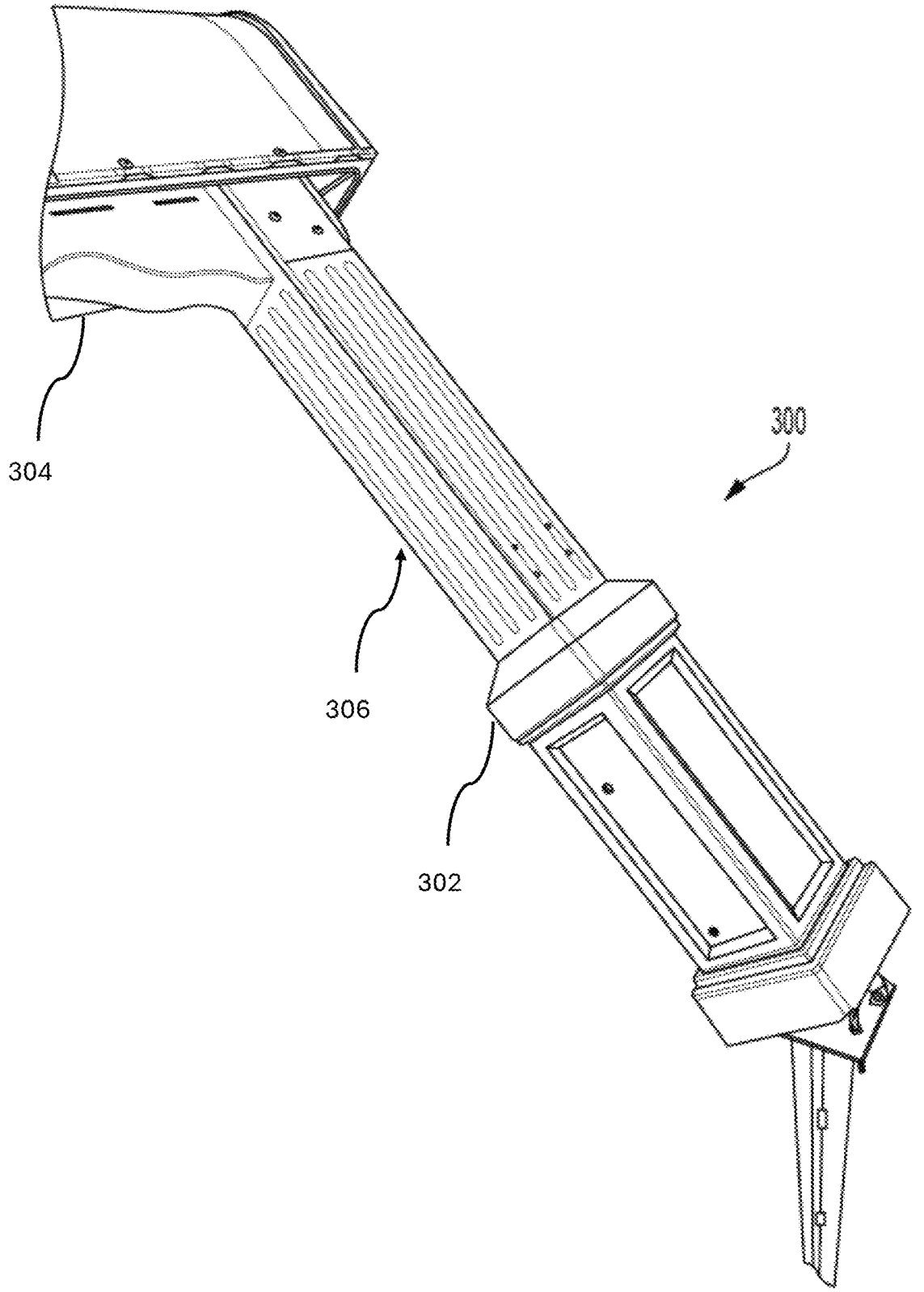
FIG. 3 is a perspective view of the mailbox impact return system according to a second configuration of the invention, in an extended position.

Now referring to FIG. 3, an image of the mailbox impact return system in an extended position 300 is shown according to a second configuration of the invention. Here, an embodiment of the invention is shown where a mailbox 304 and a mail-post 302, which form an assembly 306, are seen coupled, via the first attachment point located on an upper side of the housing 110*b*, with the mailbox impact return system in an extended position 200. The separation 202 between the first face of the housing 118 and first face of the post 120 can be seen, with the post 108. Such a position can be caused by an impact from snow resulting from street snow removal. In the embodiment of the invention seen in FIG. 3, the housing 112 is seen coupled to the assembly 306, such that the housing 112, the spring 104, and the controlled rate retraction device 102 fit within the assembly 306. The housing 112, along with hinge 106 can be located off-center from the mailbox and mail-post assembly 306. The off-center location of the plurality of parts relative to the assembly 306 minimally affects the stability and strength of the mailbox impact return system.

Figure 4:
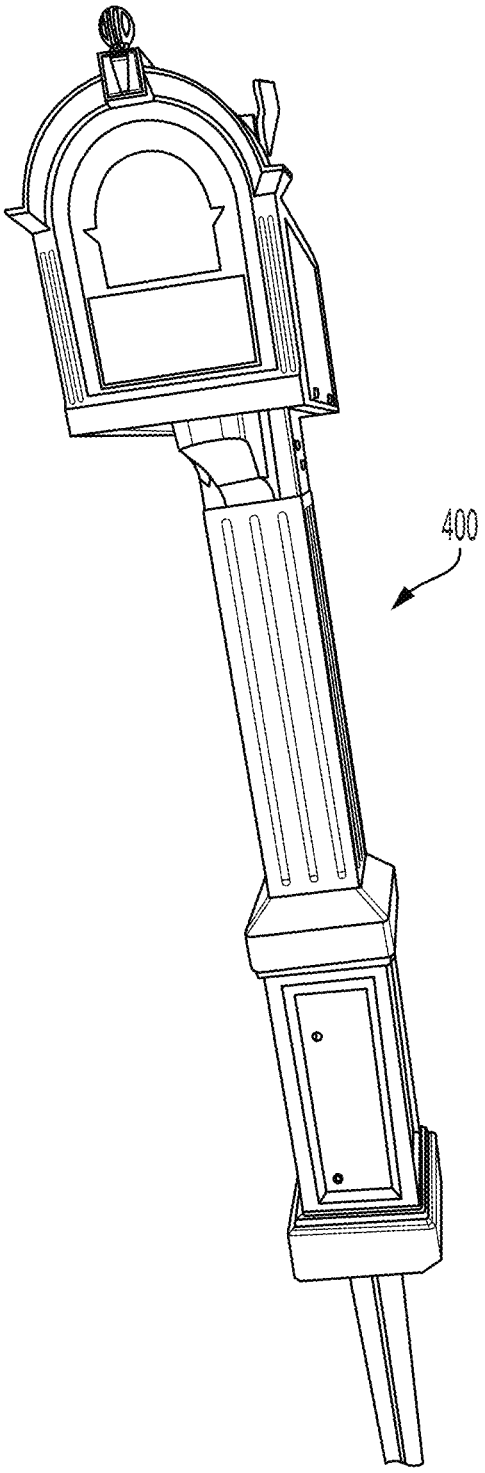
FIG. 4 is a perspective view of the mailbox impact return system according to the second configuration of the invention, in an upright position.

Now referring to FIG. 4, an image of the mailbox impact return system in an upright position 400 is shown according to the second configuration of the invention. Here, the assembly of the mailbox and mail-post 306 is seen according to the second configuration of the invention.

Figure 5:
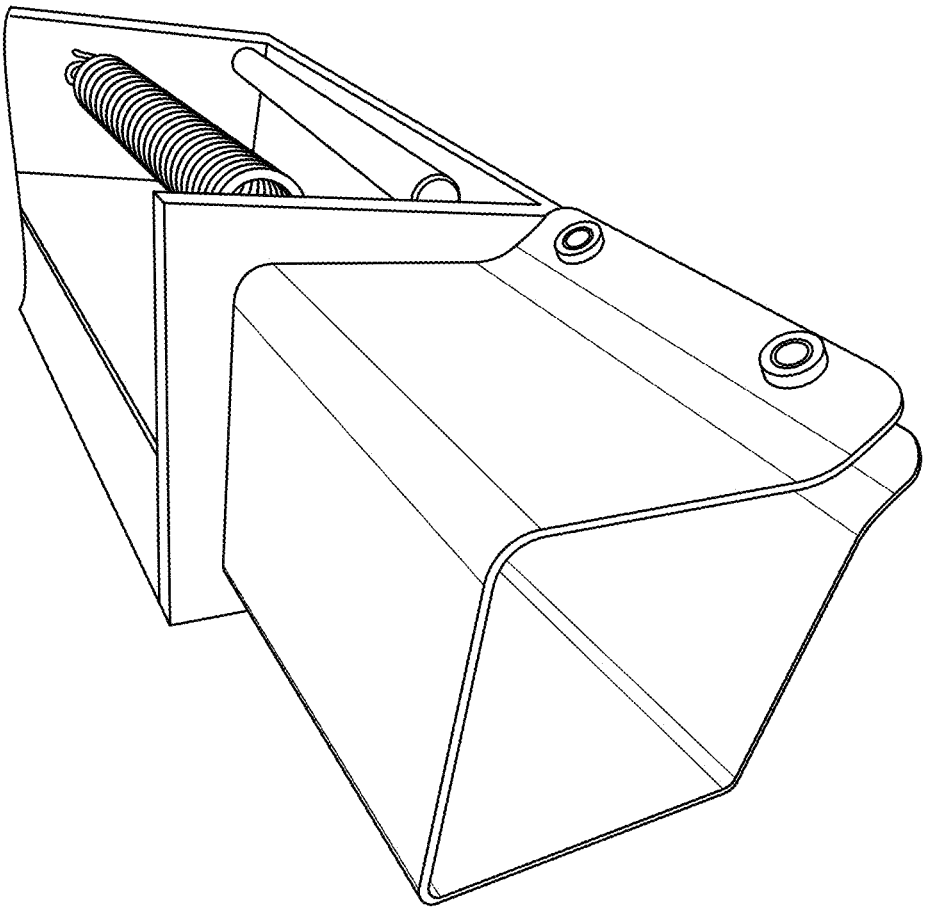
FIG. 5 is a perspective view of an alternate mounting/anchoring system for the mailbox impact return system of FIGS. 1-4.

Referring to FIG. 5 the lower portion of the mailbox impact return system includes a generally quadrilinear or square shaped receiver to which a post can insert and be clamped to. The post would preferably be buried in the ground or more preferably in cement.

What is claimed is:

1. A mailbox post apparatus comprising:

at least one first attachment point;

a housing configured to be attached to a mailbox or mail-post;

a post;

a spring connected from a first point on the housing to a first point on the post;

a controlled rate retraction device parallel to the spring to counteract the spring, connected from a second point on the housing to a second point on the post; and a hinge linking the housing with the post, wherein a separation between a first face of the housing and a face of the post is achieved in a predetermined direction, and the separation having an angle range of at least 90 degrees.

2. The apparatus according to claim 1 wherein the spring forces a retraction/contraction of a mailbox or mail-post to an upright position.

3. The apparatus according to claim 1 wherein the controlled rate retraction device extends to absorb the energy of an impact on the mailbox or mail-post from an impacting material and retracts slower than it extends.

4. The apparatus according to claim 1 wherein the controlled rate retraction device retracts, providing a slow and/or controlled return of the mailbox or mail-post from a lateral position to an upright position.

5. The apparatus according to claim 1 wherein the first attachment point allows for the mating of the apparatus with the mailbox or mail-post.

6. The apparatus according to claim 1 wherein a rectilinear receiver is configured to secure to the post which is rectilinear.

7. The apparatus according to claim 1 wherein the spring is a compression spring, an extension spring, a torsion spring, a constant force spring, a Belleville spring, a drawbar spring, a volute spring, a garter spring, a flat spring, a gas spring, or an air spring.

8. The apparatus according to claim 1 wherein the controlled rate retraction device is a pneumatic cylinder or a hydraulic cylinder.

9. The apparatus according to claim 1 wherein the post is an assembly comprising a stake and the face of the post.

10. A mailbox post apparatus comprising:

a housing configured to be attached to a mailbox or mail-post;

a spring connected from a first point on the housing to a first anchor point on an anchor device;

a hinge linking the housing to the anchor device wherein the hinge is offset to a first side relative to a center of the anchor device;

a controlled rate retraction device adjacent to the spring to counteract the spring, connected from a second point on the housing to a second point on the anchor device; and wherein a separation between a first portion of the housing and the anchor device is achieved in a predetermined direction and wherein the spring and the controlled rate retraction device is offset relative to the hinge on a side away from the predetermined direction with first side is located towards the predetermined direction.

11. The apparatus according to claim 10 wherein the spring resists extension of the mailbox or mail-post and the controlled rate retraction device retracts after extension, to provide a reduced return speed of the mailbox or mail-post from a lateral position to an upright position, the reduced return speed slower than an extension speed.

12. The apparatus according to claim 10 wherein a rectilinear is configured to secure to the anchor device which is rectilinear.

13. The apparatus according to claim 10 wherein the spring is a compression spring, an extension spring, a torsion spring, a constant force spring, a Belleville spring, a drawbar spring, a volute spring, a garter spring, a flat spring, a gas spring, or an air spring.

14. The apparatus according to claim 10 wherein the controlled rate retraction device is a pneumatic cylinder or a hydraulic cylinder.

* * * * *